US007611425B2

(12) United States Patent
Yeh

(10) Patent No.: US 7,611,425 B2
(45) Date of Patent: Nov. 3, 2009

(54) GOLF PUTTER HEAD ASSEMBLY

(76) Inventor: Mei-Chu Yeh, No. 32, Yu Hsien Street, Tainan City (TW) 70465

( * ) Notice: Subject to any disclaimer, the term of this patent is extended or adjusted under 35 U.S.C. 154(b) by 50 days.

(21) Appl. No.: 11/811,558

(22) Filed: Jun. 11, 2007

(65) Prior Publication Data

US 2008/0305886 A1 Dec. 11, 2008

(51) Int. Cl.
*A63B 53/04* (2006.01)
*A63B 53/06* (2006.01)

(52) U.S. Cl. ..... 473/337; 473/340; 473/350

(58) Field of Classification Search ..... 473/256, 473/324–350
See application file for complete search history.

(56) References Cited

U.S. PATENT DOCUMENTS

| | | | | | |
|---|---|---|---|---|---|
| 1,096,359 | A | * | 5/1914 | Dwight | 473/337 |
| 1,133,129 | A | * | 3/1915 | Govan | 473/337 |
| 1,167,387 | A | * | 1/1916 | Daniel | 473/337 |
| 1,453,503 | A | * | 5/1923 | Holmes | 473/336 |
| 1,518,316 | A | * | 12/1924 | Ellingham | 473/337 |
| 1,538,312 | A | * | 5/1925 | Beat | 473/337 |
| 1,575,364 | A | * | 3/1926 | Hodgkins | 473/311 |
| 1,674,136 | A | * | 6/1928 | Shidler | 473/242 |
| 1,840,924 | A | * | 1/1932 | Tucker | 473/337 |
| 1,913,821 | A | * | 6/1933 | Stumpf | 473/338 |
| 2,163,091 | A | * | 6/1939 | Held | 473/338 |
| 2,460,445 | A | * | 2/1949 | Bigler | 473/242 |
| 2,750,194 | A | * | 6/1956 | Clark | 473/337 |
| 3,064,980 | A | * | 11/1962 | Steiner | 473/335 |
| 3,116,926 | A | * | 1/1964 | Owen et al. | 473/457 |
| 3,897,066 | A | * | 7/1975 | Belmont | 473/337 |
| 3,979,122 | A | * | 9/1976 | Belmont | 473/336 |
| 3,979,123 | A | * | 9/1976 | Belmont | 473/337 |
| 4,052,075 | A | * | 10/1977 | Daly | 473/338 |
| 4,325,553 | A | * | 4/1982 | Taylor | 473/337 |
| 4,326,326 | A | * | 4/1982 | MacDonald | 29/428 |
| 4,614,343 | A | * | 9/1986 | Radway | 473/234 |
| 4,809,975 | A | * | 3/1989 | Lee | 482/110 |
| 4,869,507 | A | * | 9/1989 | Sahm | 473/337 |
| 4,895,371 | A | * | 1/1990 | Bushner | 473/336 |
| 5,046,740 | A | * | 9/1991 | D'Eath | 473/255 |
| 5,121,922 | A | * | 6/1992 | Harsh, Sr. | 473/251 |
| 5,244,210 | A | * | 9/1993 | Au | 473/252 |
| 5,439,222 | A | * | 8/1995 | Kranenberg | 473/309 |
| 5,571,053 | A | * | 11/1996 | Lane | 473/336 |
| 5,603,666 | A | * | 2/1997 | Bowe | 473/307 |
| 5,632,694 | A | * | 5/1997 | Lee | 473/336 |
| 5,688,189 | A | * | 11/1997 | Bland | 473/314 |

(Continued)

FOREIGN PATENT DOCUMENTS

JP 06238022 A * 8/1994

(Continued)

*Primary Examiner*—Alvin A Hunter
(74) *Attorney, Agent, or Firm*—Pro-Techtor Int'l Services; Ralph Willgohs

(57) ABSTRACT

A golf putter head assembly comprises: a putter head with a threaded sleeve, and a balance weight screwed into the threaded sleeve. Adjusting the position of the balance weight inside the threaded sleeve can change the center of gravity of the putter head to meet different player's requirements to obtain an optimum hitting stability and ball moving direction, and increase the success rate in sending the golf ball into the hole.

6 Claims, 4 Drawing Sheets

U.S. PATENT DOCUMENTS

| | | | | |
|---|---|---|---|---|
| 5,769,736 | A * | 6/1998 | Sato | 473/335 |
| 5,769,737 | A * | 6/1998 | Holladay et al. | 473/336 |
| 6,277,032 | B1 * | 8/2001 | Smith | 473/336 |
| 7,018,304 | B2 * | 3/2006 | Bradford | 473/334 |
| 7,070,515 | B1 * | 7/2006 | Liu | 473/340 |
| 7,121,956 | B2 * | 10/2006 | Lo | 473/335 |
| 7,166,040 | B2 * | 1/2007 | Hoffman et al. | 473/334 |
| 7,297,073 | B2 * | 11/2007 | Jung | 473/340 |
| 7,396,295 | B1 * | 7/2008 | Frame et al. | 473/337 |
| 2003/0027658 | A1 * | 2/2003 | Li et al. | 473/318 |
| 2007/0135230 | A1 * | 6/2007 | Consiglio | 473/332 |

FOREIGN PATENT DOCUMENTS

| | | | |
|---|---|---|---|
| JP | 2000140169 | A * | 5/2000 |
| JP | 2005323978 | A * | 11/2005 |
| JP | 2006198385 | A * | 8/2006 |
| JP | 2006239351 | A * | 9/2006 |

* cited by examiner

GOLF PUTTER HEAD ASSEMBLY

BACKGROUND OF THE INVENTION

1. Field of the Invention

The present invention relates to a golf putter head assembly, and more particularly to a putter head screwed with a balance weight, and adjusting the position of the balance weight can change the center of gravity of the putter head, so as to meet different user's needs.

2. Description of the Prior Art

Nowadays, golf is a very popular sport, and more and more people play golf. The most important thing of playing golf is to hit the golf ball into the target hole in the putting green, and whether the golf ball is hit into the hole determines the result of a competition. A golf putter head usually includes a hitting surface for hitting the golf ball, and at least one balance weight is fixed to the golf putter head to lower the center of gravity of the golf putter head. However, since the balance weight is fixed to the golf putter head in a non-adjustable manner, the center of gravity of the golf putter head is not adjustable either. Therefore, the golf player is unable to adjust the center of gravity of the putter head flexibly according to his need, and as a result, the stability of hitting the golf ball and the moving direction of the ball cannot be controlled effectively, or even it will cause a mistake of hitting the ball into the hole.

The present invention has arisen to mitigate and/or obviate the afore-described disadvantages.

SUMMARY OF THE INVENTION

The primary objective of the present invention is to provide a golf putter head assembly, which comprises:

a putter head with a threaded sleeve; and a balance weight screwed into the threaded sleeve, moving the balance weight can change the center of gravity of the putter head.

The threaded sleeve is formed with an inner threaded portion, and the balance weight is provided with an outer threaded portion to be screwed with the inner threaded portion of the threaded sleeve, so that the balance weight screwed into the threaded sleeve.

The golf putter head assembly further comprises a sleeve and an elastic member, the putter head is defined with a cavity, the threaded sleeve is formed with a through hole to be aligned with the cavity, the elastic member is disposed in the sleeve, the sleeve and the elastic member are then placed in the threaded sleeve in such a manner that the sleeve extends out of the through hole and is stopped against the cavity, the elastic member protrudes out of the sleeve and extends into the threaded sleeve, and the elastic member pushes against the balance weight.

The golf putter head assembly further comprises a cover to be screwed with the inner threaded portion of the threaded sleeve, and an open end is formed at a rear end of the inner threaded portion and is to be sealed by the cover.

DETAILED DESCRIPTION OF THE PREFERRED EMBODIMENTS

The present invention will be the clearer from the following description when viewed together with the accompanying drawings, which show, for purpose of illustrations only, the preferred embodiment in accordance with the present invention.

Figure 1:
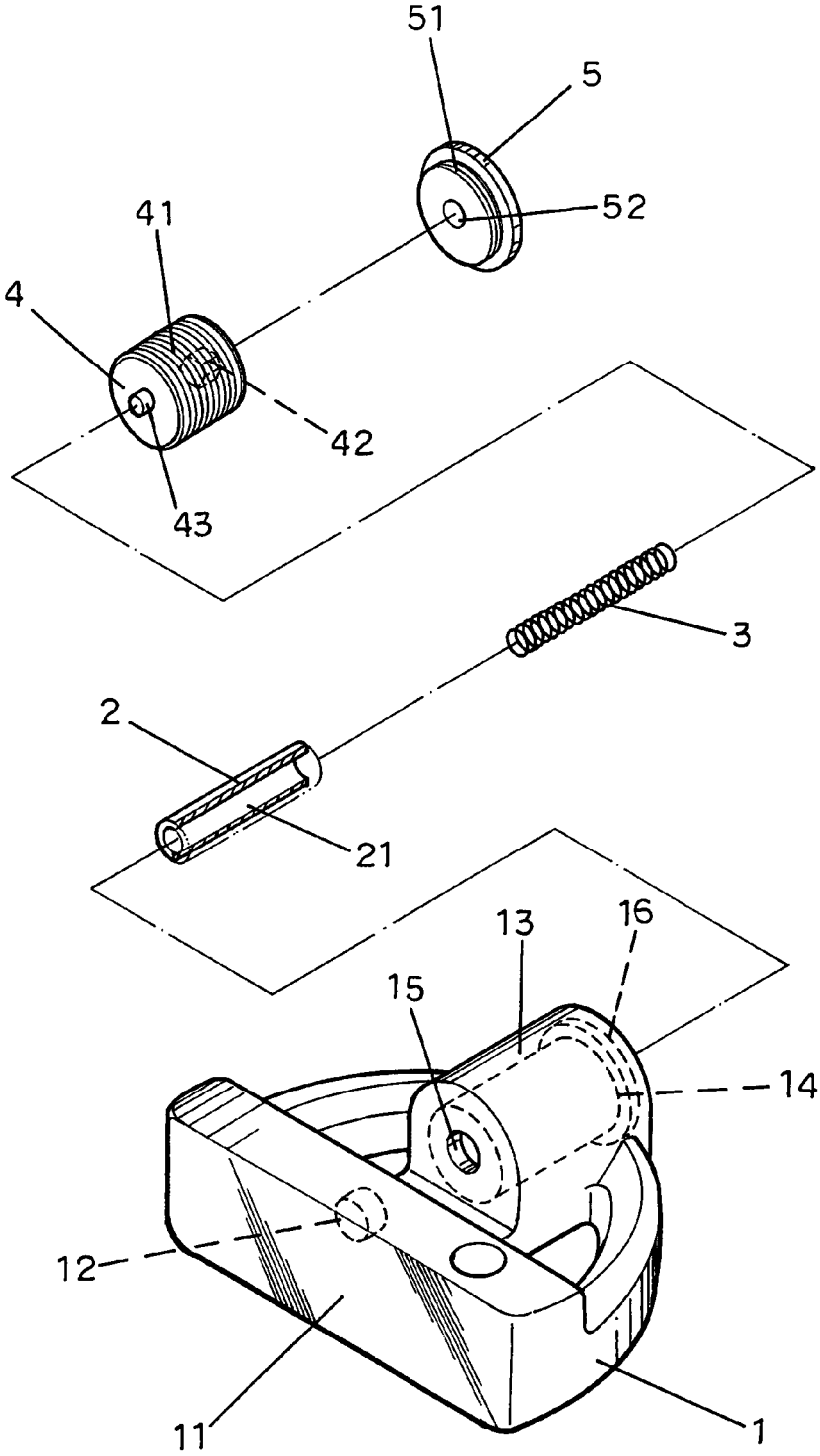
FIG. 1 is an exploded view of a golf putter head assembly in accordance with the present invention.
Figure 2:
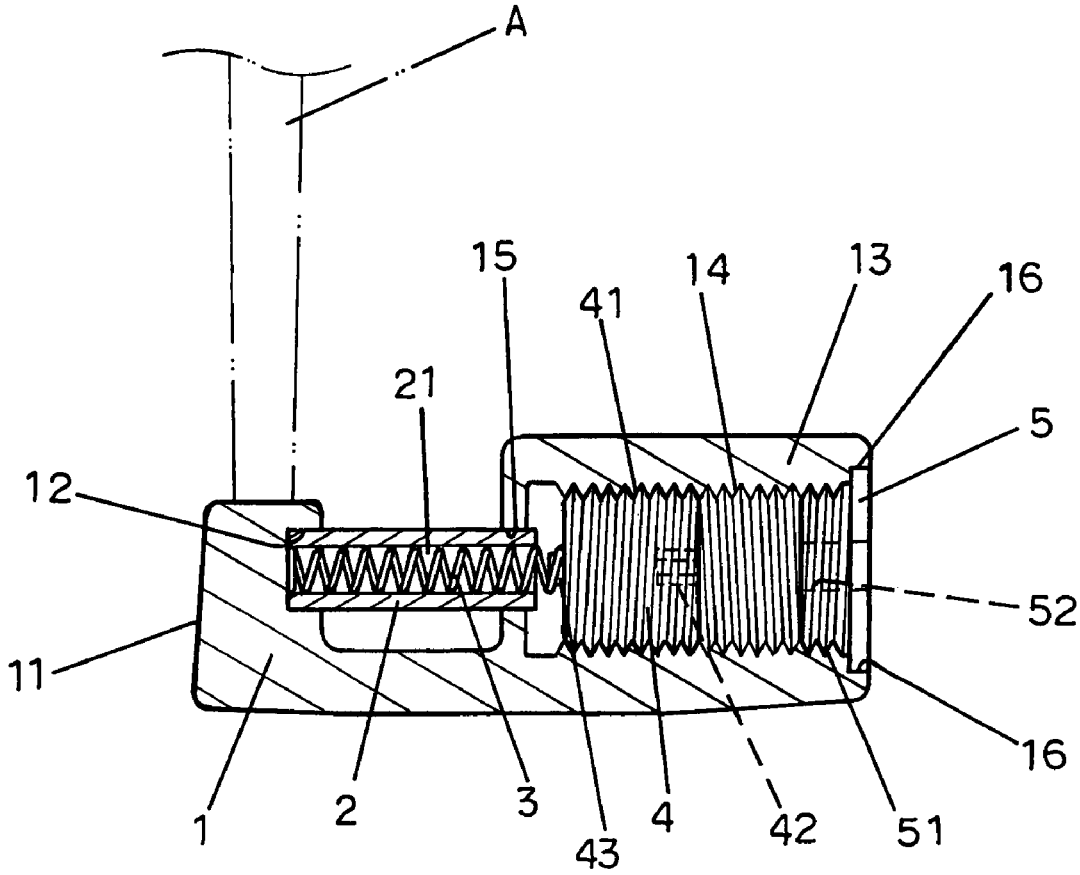
FIG. 2 is a cross sectional view of the golf putter head assembly in accordance with the present invention.

Referring to FIGS. 1 and 2, a golf putter head assembly in accordance with the present invention comprises: a putter head 1 with a threaded first sleeve 13, a second sleeve 2, an elastic member 3, a balance weight 4 and a cover 5.

The putter head 1 is fixed to the lower end of the golf putter A, at the front end of the putter head 1 is formed a hitting surface 11, and located behind the hitting surface 11 is a first seating portion 12, which in one embodiment is a cavity. A threaded first sleeve 13 is disposed at the rear end of the putter head 1, in the inner surface of the threaded first sleeve 13 is formed an inner threaded portion 14, the front end of the threaded first sleeve 13 is formed with a through hole 15 that is in communication with the inner threaded portion 14 and, aligned with the cavity 12, and at the rear end of the inner threaded portion 14 is formed an open end 16.

The second sleeve 2 is defined with a receiving portion 21.

The elastic member 3 is received in the receiving portion 21 of the second sleeve 2.

The balance weight 4 includes an outer threaded portion 41, an engaging portion 42, which in one embodiment is an engaging groove, and a seating portion 43, which in one embodiment is a protrusion.

The cover 5 is defined with a threaded portion 51 and a through hole 52 to be aligned with the engaging portion 42 of the balance weight 4.

In assembly, the second sleeve 2 and the elastic member 3 are initially inserted in the threaded first sleeve 13 of the Putter head 1 in such a manner that the second sleeve 2 extends out of the through hole 15 and is stopped against the first seating portion 12 of the putter head 1, and one end of the elastic member 3 protrudes out of the second sleeve 2 and into the threaded first sleeve 13. And then the outer threaded portion 41 of the balance weight 4 is screwed with the inner threaded portion 14 of the threaded first sleeve 13 in such a manner that the elastic member 3 is biased between the second seating portion 43 of the balance weight 4 and the first seating portion 12 of the putter head 1, as shown in FIG. 2, so that the balance weight 4 is positioned. Finally, the threaded portion 51 of the cover 5 is screwed with the inner threaded portion 14 of the threaded first sleeve 13, so as to seal the open end 16 of the inner threaded portion 14.

Figure 3:
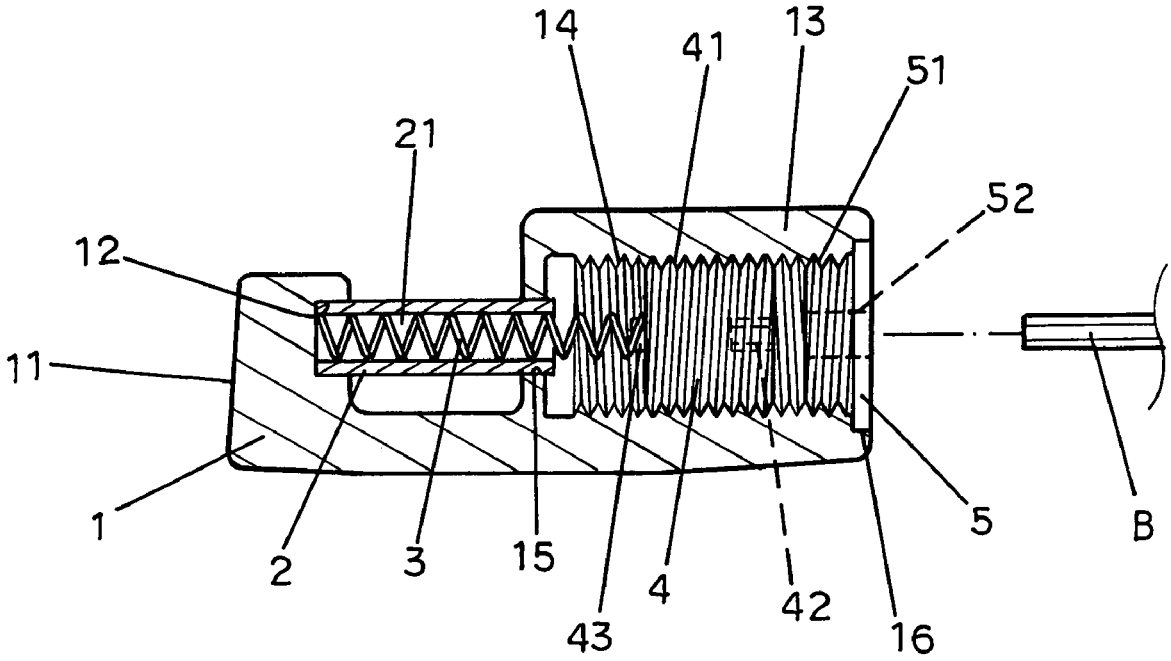
FIG. 3 is a cross sectional view in accordance with the present invention of showing that the balance weight is moved backward.

When in use, if the golf ball flies to the putting green and before it is into the hole, the surface of the putting green is undulating and to prevent the occurrence of a mistake in pushing the golf ball, a rotating tool B can be inserted through the through hole 52 of the cover 5 into the threaded first sleeve 13 and engaged in the engaging portion 42 of the balance weight 4 to rotate the balance weight 4 to a predetermined position, as shown in *Fig.* 3, thus changing the center of gravity of the putter head 1. And the center of gravity of the putter head 1 is adjustable according to the individual player's preference. The elastic member 3 pushes against the balance weight 4 to prevent the oscillation of balance weight 4 during a hitting action, as shown in FIGS. 2 and 3. Therefore, the center of gravity of the putter head 1 can be adjusted according to the player's needs in order to obtain a hitting stability.

Figure 4:
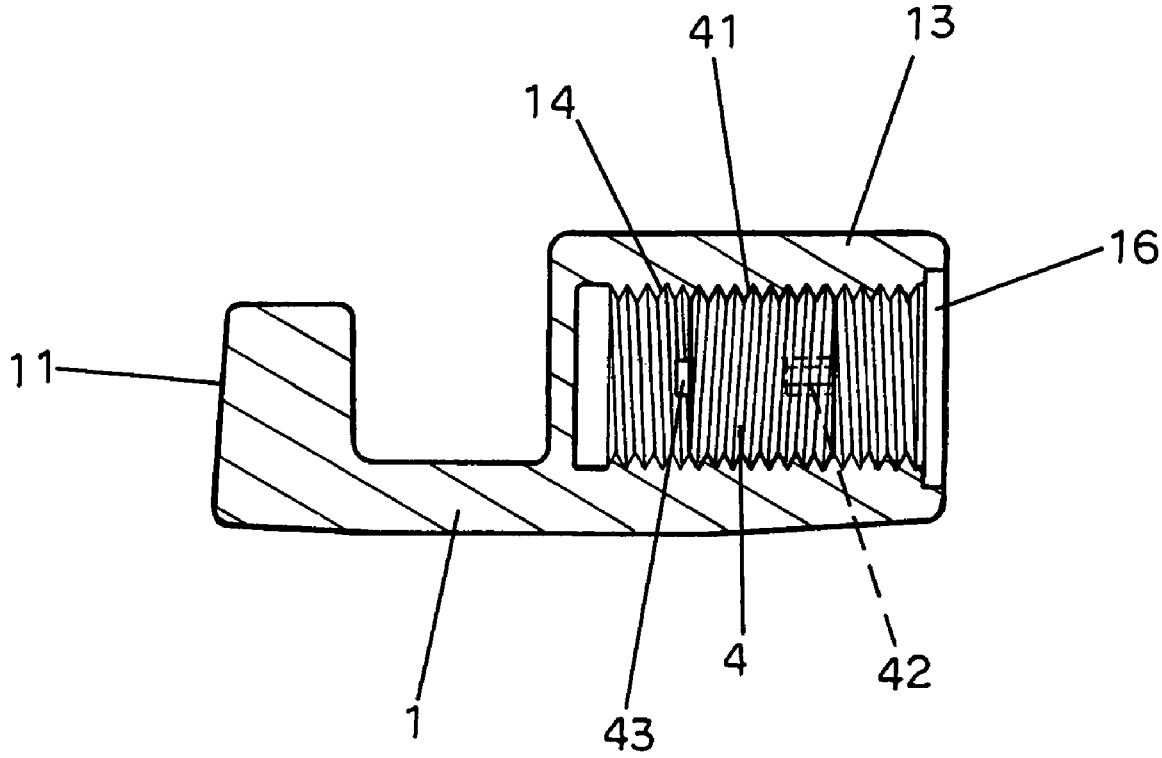
FIG. 4 is a cross sectional view in accordance with the present invention of show a golf putter head assembly without sleeve, elastic member and cover.

The second sleeve 2, the elastic member 3 and the cover 5 can also be omitted, as shown in FIG. 4, the balance weight 4 can still be adjusted to the proper position to change the center of gravity of the putter head 1.

The golf putter head assembly stated above is provided with one threaded first sleeve 13 in which being disposed one second sleeve 2, one elastic member 3, one balance weight 4 and one cover 5, it can also be provided with a plurality of threaded first sleeves 13 in each of which being disposed one second sleeve 2, one elastic member 3, one balance weight 4 and one cover 5.

The balance weights 4 can be made of different materials to have different weights according to real needs, thus providing more choices for adjusting the center of gravity of the putter head 1. The balance weight 4 can be divided into a plurality of pieces and then disposed in the threaded first sleeve 13 of the putter head 1 (not shown), and this method can also provide more choices for adjusting the center of gravity of the putter head 1.

It is understood from the above description that the putter head 1 is screwed with the balance weight 4, adjusting the position of the balance weight 4 inside the threaded first sleeve 13 can change the center of gravity of the putter head 1 to meet different player's requirements to obtain an optimum hitting stability and ball moving direction, and increase the success rate in sending the golf ball into the hole.

While we have shown and described various embodiments in accordance with the present invention, it is clear to those skilled in the art that further embodiments may be made without departing from the scope of the present invention.

What is claimed is:

1. A golf putter head assembly comprising:

a putter head having a generally vertical hitting surface on a forward portion for striking a golf ball, a first seating portion formed on a rearward surface of the forward portion;

an internally threaded first sleeve centrally positioned on a rearward portion of the putter head and aligned with the first seating portion, the first sleeve having a substantially horizontal axis generally orthogonal to the hitting surface, a partially closed front end with an axial through hole and an open rear end;

a balance weight with a horizontally adjustable position in the threaded first sleeve, a front surface with a second seating portion, and a rear surface with an engaging portion, whereby moving the balance weight can change the center of gravity of the putter head;

a second sleeve aligned with the first sleeve, with a front end seated in the first seating portion and a rear end entering the through hole of the front surface of the balance weight; and an elastic member, disposed in a receiving portion of the second sleeve, with a front end stopped against the forward portion of the putter head and a rear end engaging the second seating portion of the balance weight;

wherein the first seating portion, the threaded first sleeve, the through hole, the elastic member, the second seating portion and the second sleeve are aligned, with the second sleeve and the elastic member disposed in the threaded first sleeve in such a manner that the second sleeve extends forward out of the through hole and is stopped against the first seating portion, the elastic member protrudes out of the second sleeve and extends into the threaded first sleeve, and the elastic member pushes against the balance weight and the forward portion of the putter head.

2. The golf putter head assembly as claimed in claim 1, wherein the second seating portion of the balance weight is a protrusion for positioning the elastic member.

3. The golf putter head assembly as claimed in claim 1, wherein the engaging portion of the balance weight is an engaging grove for engaging with a rotating tool.

4. The golf putter head assembly as claimed in claim 1, wherein the threaded first sleeve, the balance weight, the second sleeve, the elastic member, the first seating portion, and the second seating portion are coaxially aligned.

5. The golf putter head assembly as claimed in claim 3 further comprising a cover to be screwed with the inner threaded portion of the threaded first sleeve, whereby the open end of the threaded first sleeve is sealed by the cover.

6. The golf putter head assembly as claimed in claim 1, wherein the first seating portion of the putter head is a protrusion for positioning the elastic member.

* * * * *